US005491997A

United States Patent [19]

Ogawa

[11] Patent Number: 5,491,997

[45] Date of Patent: Feb. 20, 1996

[54] APPARATUS AND METHOD FOR FORMING A HEAT EXCHANGER INNER FIN HAVING CROSS-FLOW PASSAGES

[75] Inventor: Yuji Ogawa, Handa, Japan

[73] Assignee: Nippondenso Co., Ltd., Japan

[21] Appl. No.: 312,970

[22] Filed: Sep. 30, 1994

Related U.S. Application Data

[62] Division of Ser. No. 288,202, Aug. 11, 1994, which is a continuation of Ser. No. 173,110, Dec. 27, 1993, abandoned, which is a continuation of Ser. No. 964,635, Oct. 22, 1992, abandoned.

[30] Foreign Application Priority Data

Oct. 23, 1991 [JP] Japan ..... 3-275141

[51] Int. Cl.[6] ..... B21D 13/04

[52] U.S. Cl. ..... 72/177; 72/196; 72/379.6

[58] Field of Search ..... 72/177, 180, 187, 72/188, 196, 197, 379.6; 29/890.049

[56] References Cited

U.S. PATENT DOCUMENTS

| | | | |
|---|---|---|---|
| 1,616,968 | 2/1927 | Hall . | |
| 2,163,063 | 6/1939 | Romanoff | 72/196 |
| 2,488,615 | 11/1949 | Arnold . | |
| 2,757,628 | 8/1956 | Johnston . | |
| 3,394,736 | 7/1968 | Pearson . | |
| 3,686,917 | 8/1972 | Hikida et al. | 72/196 |
| 4,163,474 | 8/1979 | MacDonald et al. . | |
| 4,688,311 | 8/1987 | Saperstein et al. . | |
| 5,056,348 | 10/1991 | Albrecht et al. . | |
| 5,078,207 | 1/1992 | Asano et al. . | |

FOREIGN PATENT DOCUMENTS

| | | |
|---|---|---|
| 62-212025 | 9/1987 | Japan . |
| 154136 | 11/1989 | Japan . |
| 1184125 | 3/1970 | United Kingdom . |
| 2059042 | 4/1981 | United Kingdom . |

OTHER PUBLICATIONS

Patent Abstract of Japan, vol. 13 No. 178(M819) Apr. 1989 re JP–A 1011022.

Patent Abstract of Japan, vol. 13 No. 310 (M850) Jul. 1989 re JP–A 1098896.

*Primary Examiner*—Lowell A. Larson

*Attorney, Agent, or Firm*—Cushman Darby & Cushman

[57] ABSTRACT

In a heat exchanger, an inner fin is formed from a thin plate of aluminum alloy having a corrugated cross-section in a widthwise direction. The inner fin includes multiple crest surfaces extending parallel to one another in a lengthwise direction and multiple trough surfaces extending parallel to one another in the lengthwise direction. The crest surfaces and the trough surfaces are connected together by inclined surfaces. The crest surfaces have concavities which are shifted relative to one other in the lengthwise direction of the fin so that the concavities formed in adjacent crest surfaces are not aligned with one another in the widthwise direction. The inner fin inserted into the tube partitions the passages which communicate with each other through the concavities.

19 Claims, 9 Drawing Sheets

APPARATUS AND METHOD FOR FORMING A HEAT EXCHANGER INNER FIN HAVING CROSS-FLOW PASSAGES

This is a division of application Ser. No. 08/288,202, filed Aug. 11, 1994 which was a continuation of Ser. No. 08/173,110 filed Dec. 27, 1993, now abandoned, which was a continuation of Ser. No. 07/964,635 filed Oct. 22, 1992, now abandoned.

BACKGROUND OF THE INVENTION

1. Field of the invention

The present invention relates to an inner fin for a heat exchanger, and in particular, to an inner fin fixedly inserted into a heat exchange tube and a manufacturing method of the same.

2. Description of the Background Art

The inner fin inserted into the heat exchanger tube in the prior art is formed of a thin plate, which can be inserted into an insertion aperture of the tube, and has a corrugated section in a widthwise direction. For example, as shown in FIG. 12, a tube 1 having a fluid passage of a flat section accommodates an inner fin 2 formed of a thin corrugated plate, which has parallel crests and troughs having a height of $h_0$ and extending in a lengthwise direction of the tube. FIG. 12 shows the inner fin 2 partially drawn out from the tube 1, but in a practical state, the inner fin 2 is completely inserted into the tube 1, and the crest surfaces 2*a* of the inner fin 2 are brazed to an inner wall of the tube 1.

Passages for cooling medium are defined by inclined surfaces 2*c*, which extend between the crest surfaces 2*a* and the trough surfaces 2*b*, and the inner wall of the tube. These passages extend in the lengthwise direction of the tube and are partitioned from each other by the inner fin.

According to the inner fin thus formed for the heat exchanger, the passages formed between the inner wall of the tube and the surfaces of the inner fin may be clogged with contaminant such as dust and/or residue (e.g., flux residue generated in a manufacturing step) in the cooling medium flowing in the passages. If one or some passages are clogged, a total flow of the cooling medium flowing through the tube 1 decreases, and thus a heat exchanger performance decreases correspondingly of the reduction of the volume of the heat exchange medium.

SUMMARY OF THE INVENTION

An object of the present invention is to provide an inner fin, which can minimize reduction of the total flow of fluid in a tube and thus can prevent reduction of the heat exchanger performance even in such a case that passages partitioned by the inner fin are partially clogged, and to provide a manufacturing method of the same. Another object of the invention is to provide a manufacturing method for forming the foregoing inner fin in a simple manner.

The inner fin of the present invention has a corrugated section in a widthwise direction, and has concavities which are formed in the crest surfaces and are spaced from the first or second inner wall of the tube into which the inner fin is inserted.

In a manufacturing method of an inner fin according to the invention, a thin plate is transported and formed by rotation and pressing of first and second forming rollers, and, in the forming operation, the plate is formed into a corrugated configuration in an axial direction of the rollers and simultaneously is formed to have concavities in crest surfaces of the corrugated plate.

The invention further provides a forming apparatus for an inner fin having a pair of forming rollers for forming the inner fin, wherein the rollers have a plurality of parallel grooves formed in peripheral surfaces of the rollers, a plurality of parallel projections formed between the adjacent grooves, and a plurality of concavities formed in the projections.

According to the inner fin of the invention, even if one or some of the passages, which are defined in the tube by the partitions, i.e., inner fin, are clogged for some reason, the fluid in the clogged passage(s) flows through the concavities into the adjacent passage(s). Therefore, the fluid in the clogged passage(s) is prevented from being completely stopped, so that the reduction of the total flow can be minimized and the reduction of the heat exchanger performance can be suppressed.

According to the manufacturing method of the invention, the concavities are formed with making the corrugated configuration having the crest and trough surfaces.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

An embodiment of the invention will be described below with reference to the accompanying drawings.

FIGS. 1–4 show an embodiment, in which an inner fin of the invention is applied to a heat exchanger tube used in an air conditioner for an automobile.

Figure 1A:
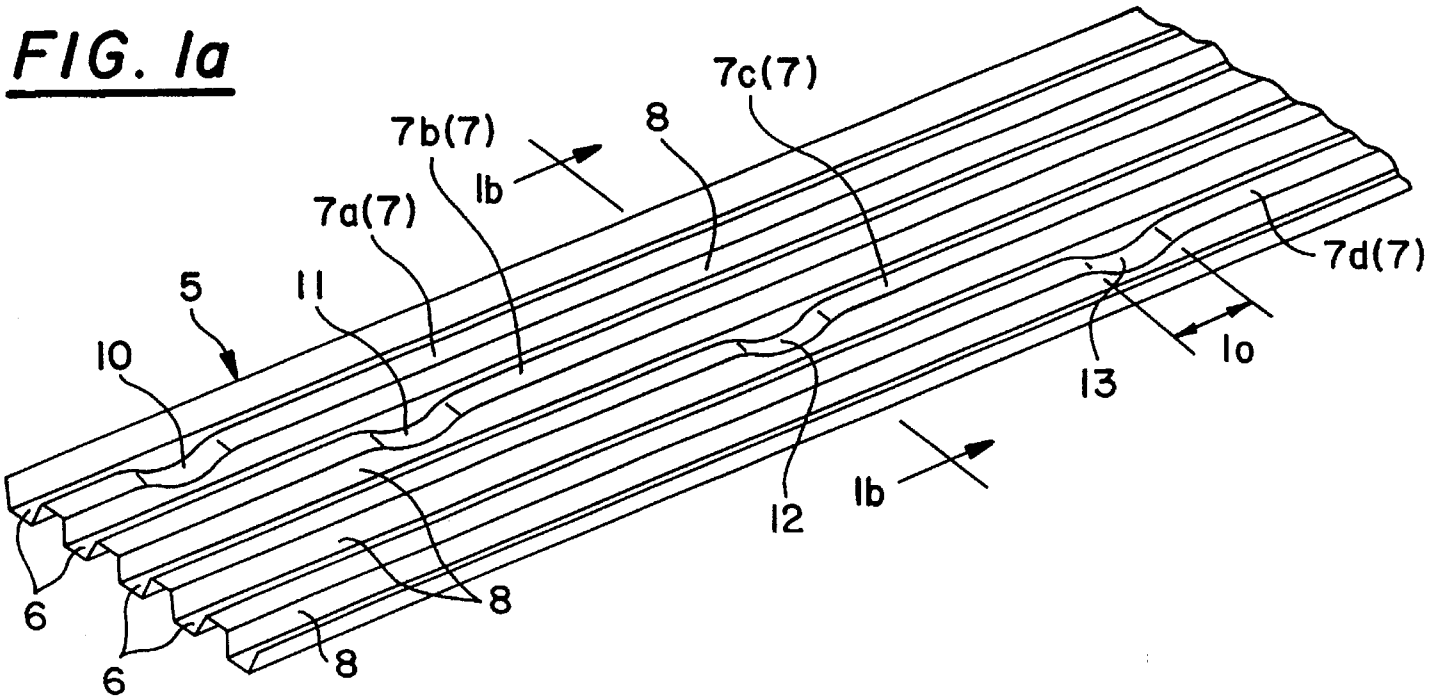
FIG. 1(*a*) is a schematic perspective view showing an inner fin according to an embodiment of the invention, and FIG. 1(*b*) is a cross section taken along line 1*b*—1*b* in FIG. 1(*a*)
Figure 1B:
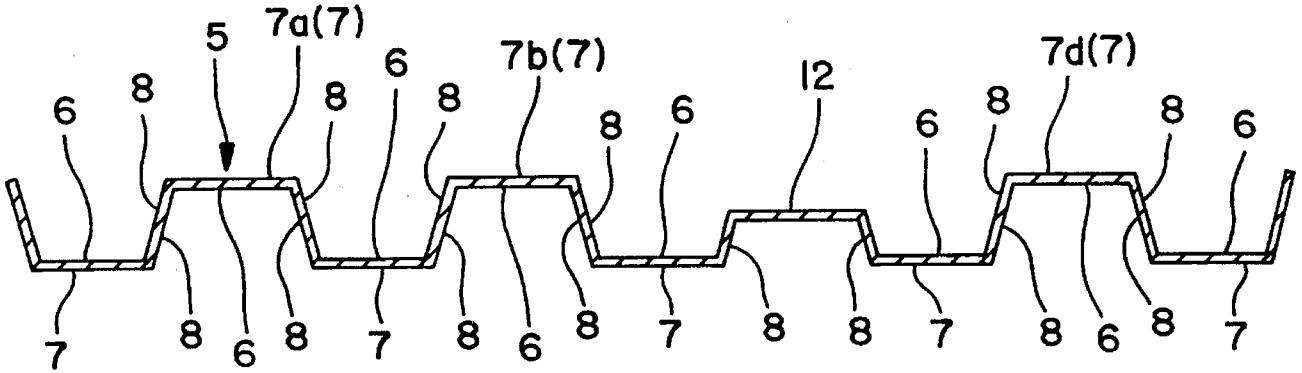

As shown in FIG. 1(*a*), an inner fin 5 is formed of a thin plate which extends in a lengthwise direction and has a corrugated section in a widthwise direction. The thin plate is made of aluminum or aluminum alloy. In a plan view, trough surfaces 6 and crest surfaces 7 are connected together by inclined surfaces 8, and the trough surface 6 and the crest surfaces 7 are located alternately in the widthwise direction. The illustrated crest surfaces 7 are four in number and extend parallel in the lengthwise direction in the top view, as shown in FIG. 1.

In FIG. 1(*b*), the crest surfaces 7 are designated by "7*a*", "7*b*", "7*c*" on, the concavities 10, 11 and 12 represented by solid line hatching are formed in the front surface of the inner fin 5. Similarly, concavities 20, 21, 22 and 23 represented by dashed line hatching are formed in the parallel crest surfaces of the opposite surface, i.e., rear surface. Since these concavities 20, 21, 22 and 23 are located at the side opposite to the front surface, they form convexities formed in the trough surfaces when viewed from the front side.

Figure 2A:
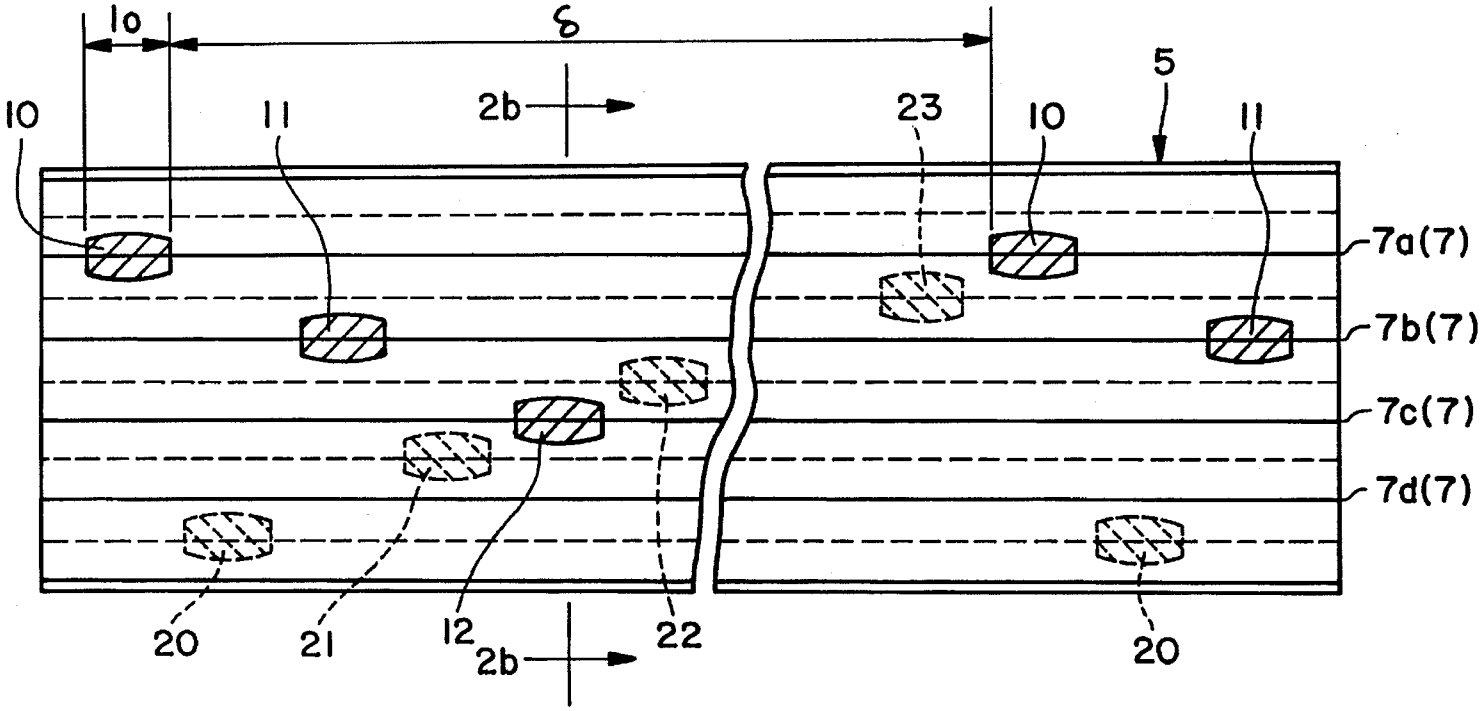
FIG. 2(*a*) is a fragmentary schematic enlarged view at a compressed scale in the lengthwise direction of an inner fin, showing an inner fin according to an embodiment of the invention, with a certain part cut away, and FIG. 2(*b*) is a cross section taken along line 2*b*—2*b* in FIG. 2(*a*)
Figure 2B:
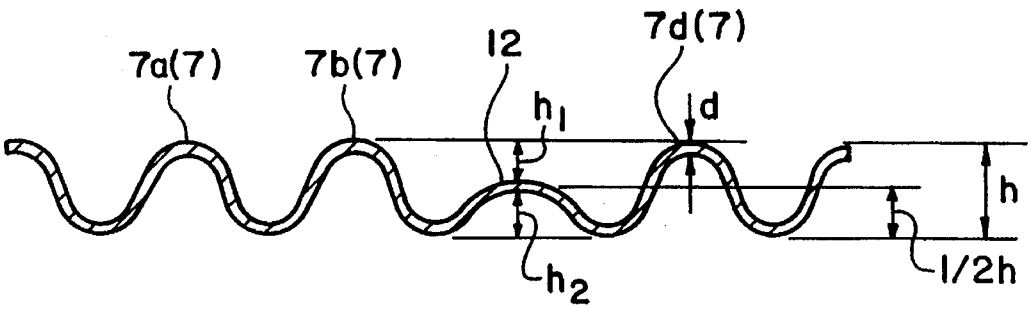

Assuming that each crest has a height of h and the plate has a thickness of d, as shown in FIG. 2(*b*), the height of the concavities 10, 11, 12, 13, 20, 21, 22 and 23 is determined such that the concavity 12 has the height of h/2 if measured from a center of the thickness of the plate. In connection with the height of the crest, concave lengths h1 and h2 shown in FIG. 2(*b*) are determined as follows. The length h1 allows the fluid to pass through the concavity 12 between adjacent passages C and D, which are formed by inserting the inner fin 5 into the tube 5. The length 12 of the concavities formed in the rear surface is determined to allow flow of the fluid through a passage E located at the same position as the concavity 12 in the rear surface.

In FIG. 2(*a*), a distance δ between the lengthwise adjacent concavities 10 may be appropriately determined in accordance with the condition of use. Also, the number of the concavities 10, which are formed in one crest surface (i.e., 7*a*) of the inner fin 5, as well as the lengthwise length 10 of one concavity 10 may be appropriately determined in accordance with the condition of use.

Figure 3:
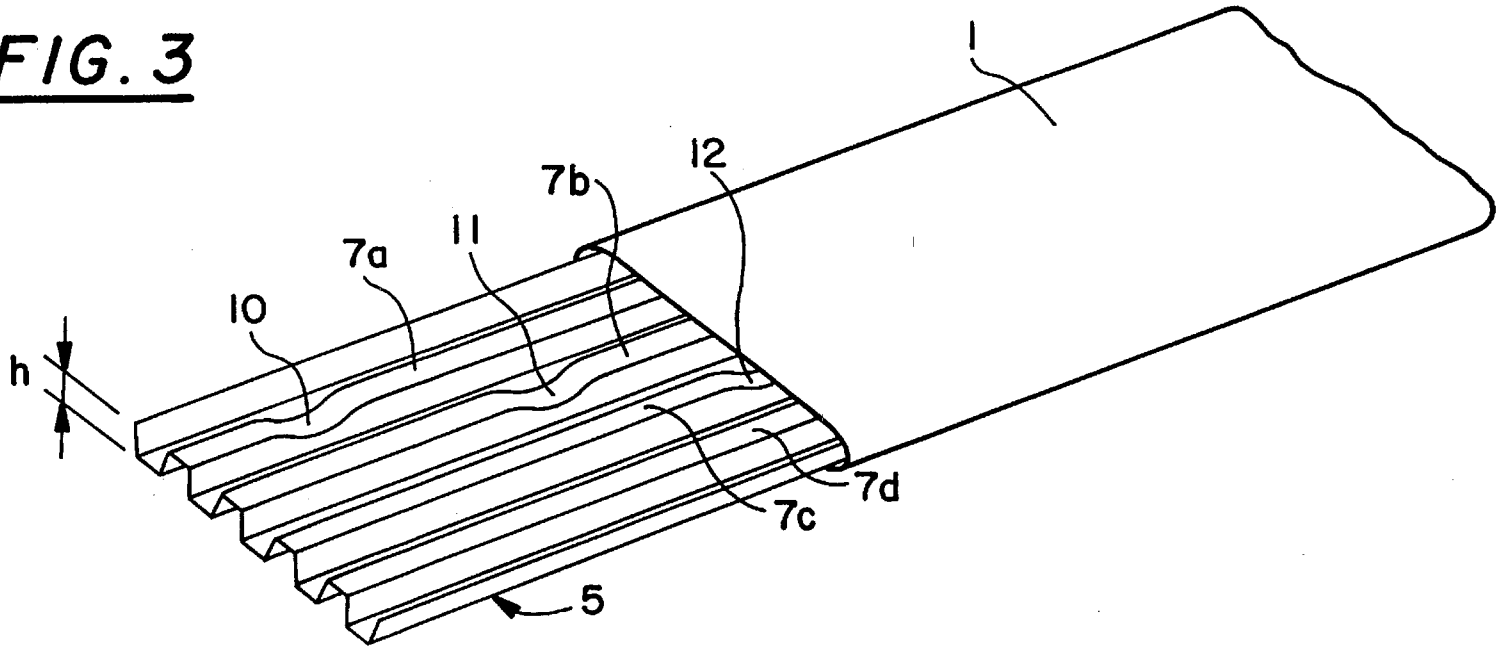
FIG. 3 is a schematic perspective view showing an inner fin according to an embodiment of the invention, which is partially drawn from a heat exchanger tube.

The inner fin 5 thus formed is fixedly inserted into the tube having a flat and oblong aperture. For example, as shown in FIG. 3, the inner fin 5 is inserted into the flat tube 1. For the sake of clarity, in FIG. 3, the inner fin 5 is shown to be partially drawn out from the tube 1. The inner fin 5 completely inserted into the tube 1 is brazed thereto with non-corrosive flux, for instance, potassium aluminum fluoride. An Al-Si-alloy material is adopted as a brazing material.

Figure 4:
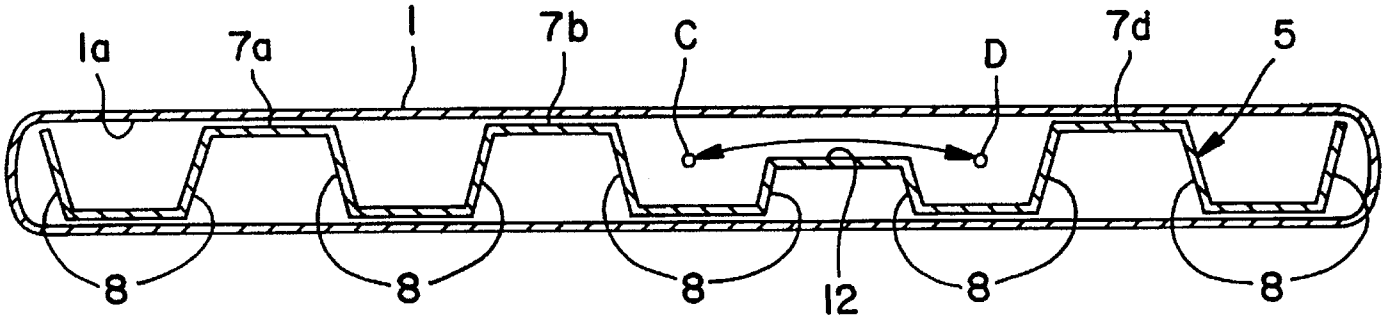
FIG. 4 is a schematic cross section showing an inner fin according to an embodiment of the invention, which is inserted into a heat exchanger tube.

FIG. 4 shows a plurality of parallel passages, which are defined by the inner wall la of the tube 1 and the inner fin 5 and extend in the lengthwise direction of the tube. The adjacent passages C and D are partitioned by the inner fin 5. The passages C and D formed at opposite sides of the concavity 12 in the inner fin 5 communicate with each other through the concavity, as indicated by arrow. Therefore, the cooling medium flowing through the passages C and D can flow into and from the passages D and C through-the concavity 12. For example, when the passage C is clogged with contaminant, the fluid in the passage C can flow into the passage D through the concavity 12. Therefore, it is possible to prevent significant reduction of the flow in a case of the clogging of the passage C with the contaminant. The crest surfaces 7*a*, 7*b*, 7*c* and 7*d* are provided with the concavities, which correspond to the foregoing concavity 12 and are spaced by predetermined distances from each other in the lengthwise direction. Therefore, even if one of the passages is clogged, the fluid can flow from the clogged passage into the adjacent passages through the concavities 10, 11, 12, 13, 20, 21, 22 and/or 23. The crest surfaces 7 are brazed to the inner wall 1*a* of the tube 1.

Figure 5:
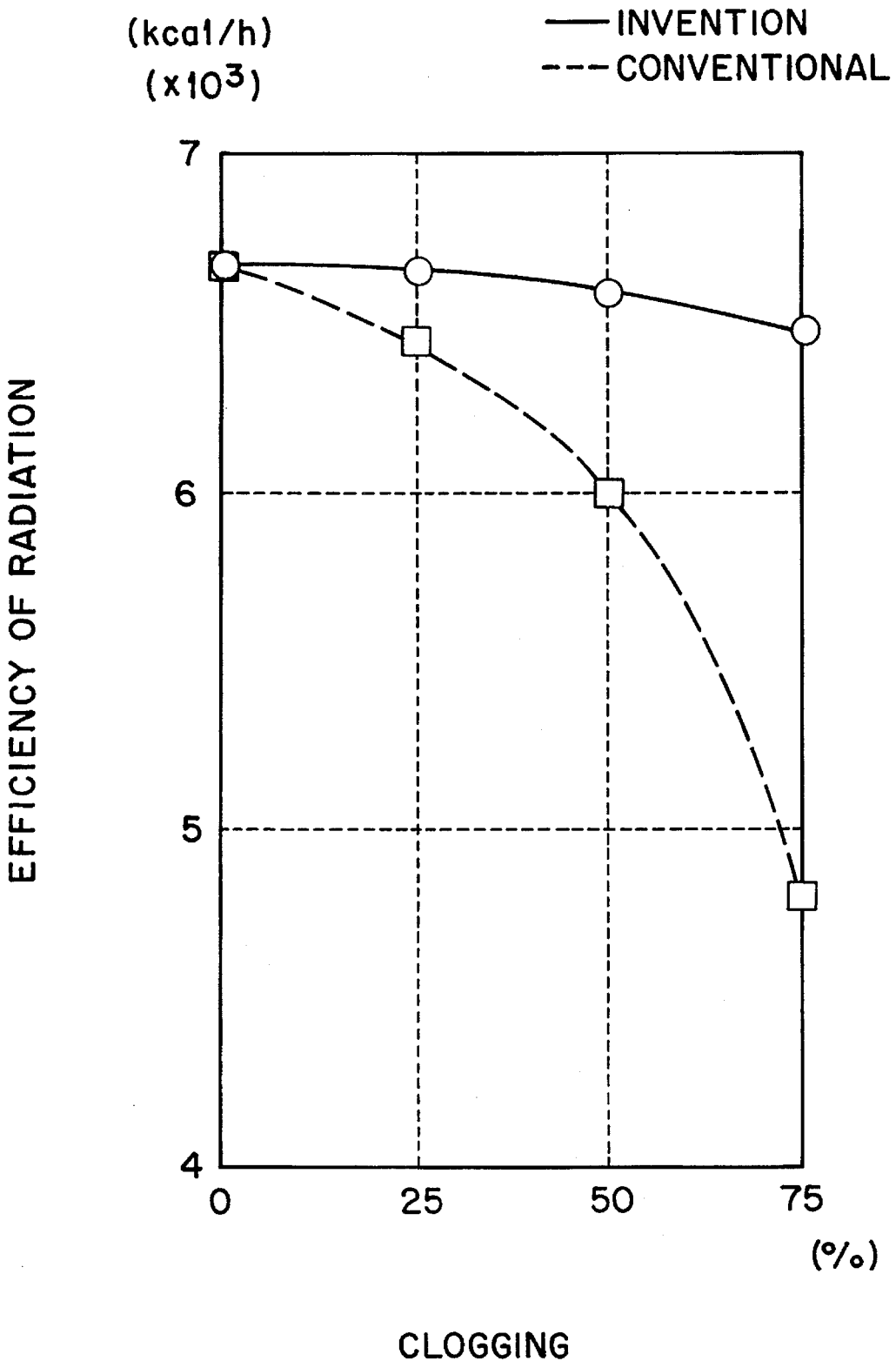
FIG. 5 is a characteristic diagram for comparing an embodiment of the invention with a conventional example for comparison with respect to a relationship between degrees of clogging and heat releasing performances.

FIG. 5 shows a relationship between the heat releasing performance and the degree of clogging of the tube, into which the foregoing inner fin is inserted, with the contaminant. The degree of clogging represents a sectional area of the clogged portion of the passage with respect to the sectional area of the passage across the tube.

In the inner fin of the embodiment used in this experiment, the concavities, which are formed in the crest surfaces corresponding to the crest surfaces 7 shown in FIG. 2(*a*) and 2(*b*), each have the lengthwise length 10 of 10 mm, and are spaced lengthwise by the distance 6 of about 205 mm. The concavities 12 each have the length h1 of about 0.3 mm between the bottom of the concavities and the crest surfaces 7.

In the conventional example for comparison, when the degree of clogging of the tube accommodating the inner fin is 25%, the heat releasing performance is reduced 3% as compared with the heat releasing performance corresponding to the degree of clogging of 0%. In contrast to this, according to the foregoing embodiment, when the degree of clogging is 25%, the heat releasing performance is substantially equal to that corresponding to the degree of clogging of 0%. The reason for this can be considered as follows. According to the inner fin of the foregoing embodiment, the cooling medium in the clogged ,passage can flow to the adjacent passages through the concavities, and consequently, in the case that the degree of clogging is 25%, the heat releasing performance is improved about 3% as compared with the conventional inner fin.

Figure 6:
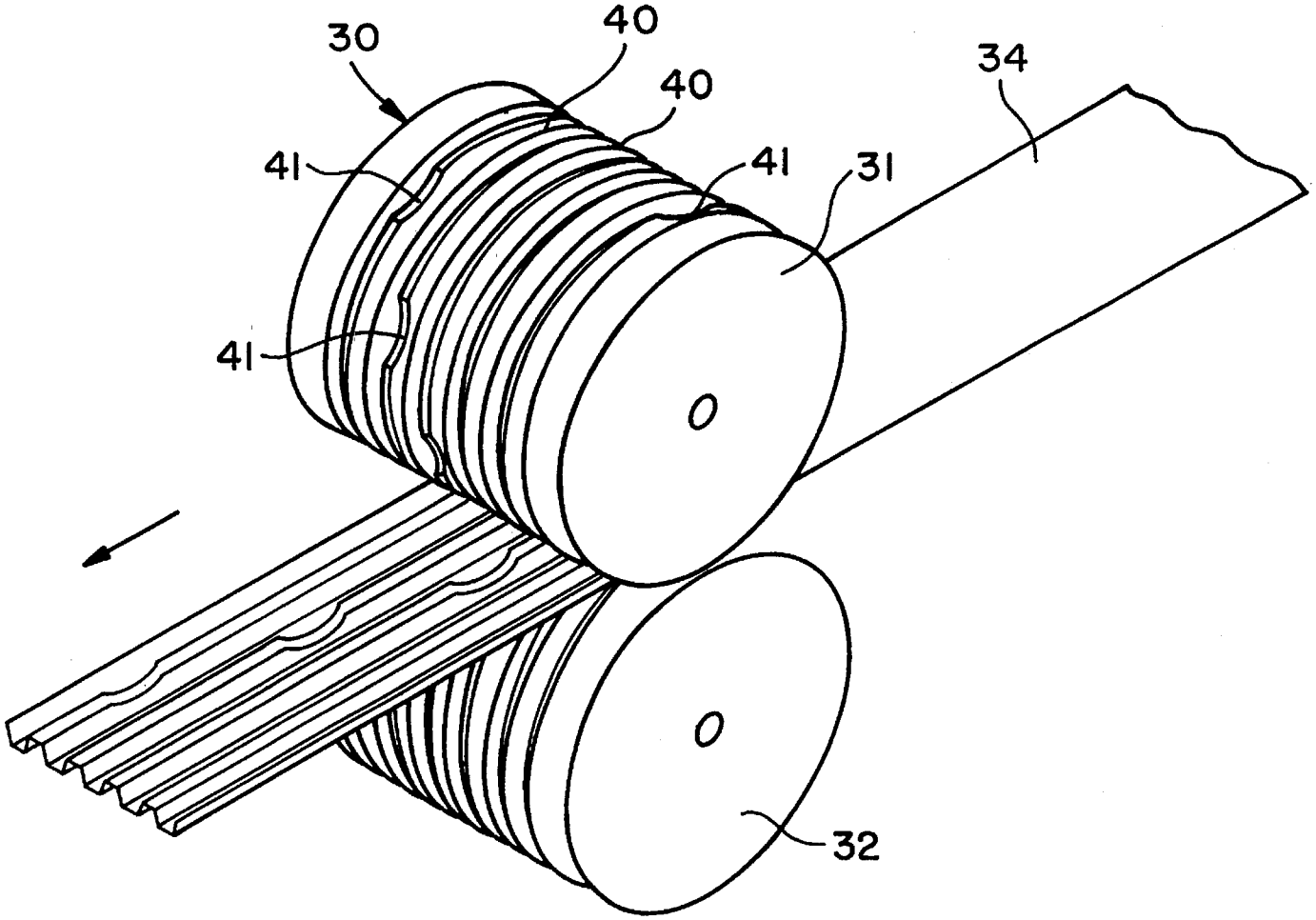
FIG. 6 is a schematic perspective view showing a forming apparatus for manufacturing an inner fin according to an embodiment of the invention.

FIG. 6 shows a forming apparatus for manufacturing the inner fin.

The forming apparatus 30 includes a pair of forming rollers 31 and 32 for applying the roll forming to a band plate 34. The rollers 31 and 32 have corrugated peripheral surfaces. The band plate 34 which is transported in the direction indicated by arrow is formed in a corrugated shape by the rollers 31 and 32, whereby the inner fin is formed, and then is cut into predetermined lengths. In this manner, the foregoing inner fin 5 is manufactured relatively facilely by the roll forming.

FIG. 7–10 show the configurations of the rollers 31 and 32.

Figure 7B:
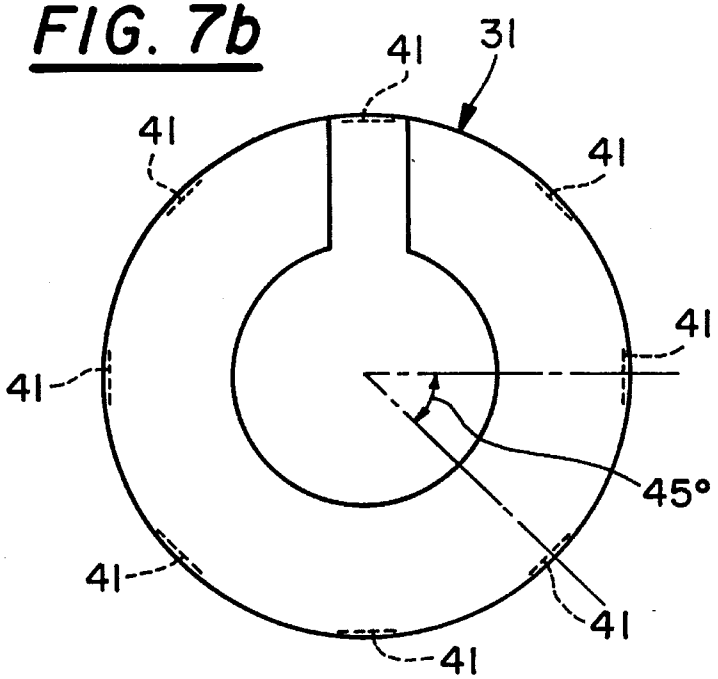
FIG. 7(*a*) is a front view showing an upper roller of a forming apparatus according to-an embodiment of the invention, and FIG. 7(*b*) is a side view thereof.
Figure 7A:
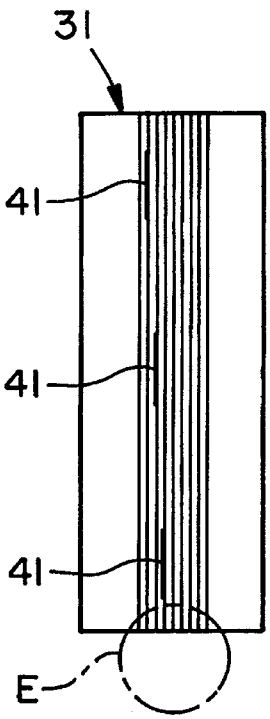
Figure 8:
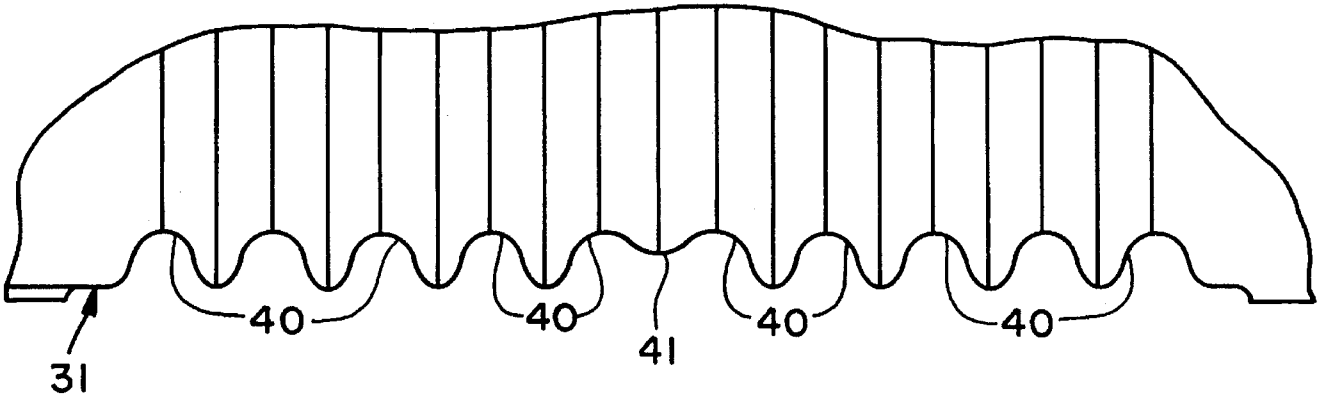
FIG. 8 is an enlarged front view of a portion indicated by "E" in FIG. 7.
Figure 9B:
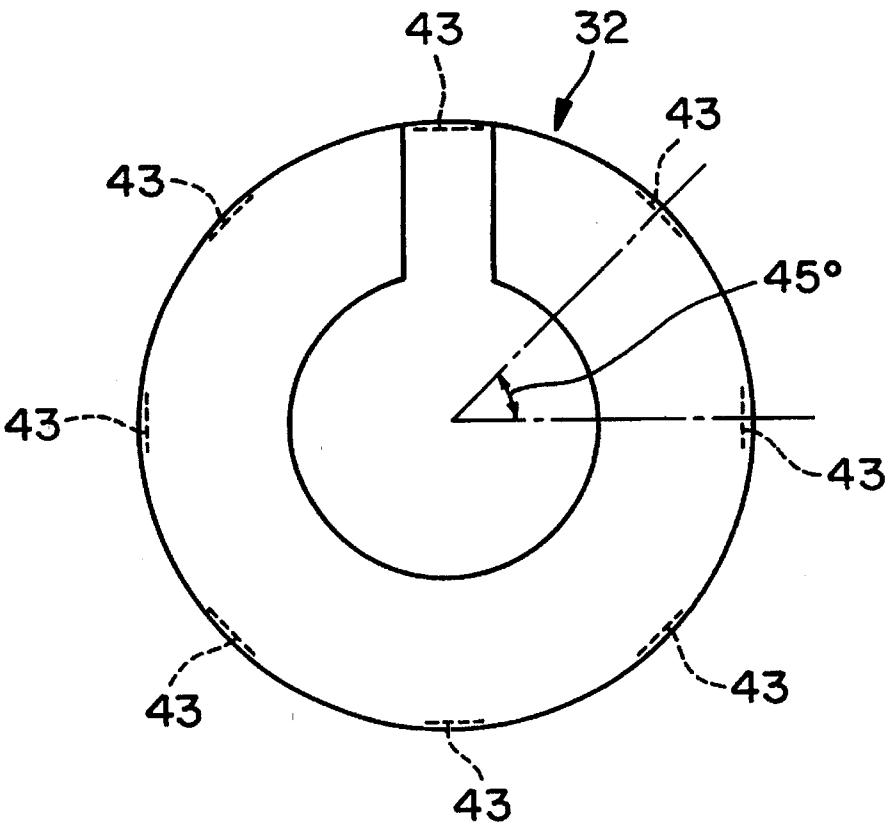
FIG. 9(*a*) is a front view showing a lower roller of a forming apparatus according to an embodiment of the invention, and FIG. 9(*b*) is a side view thereof.
Figure 9A:
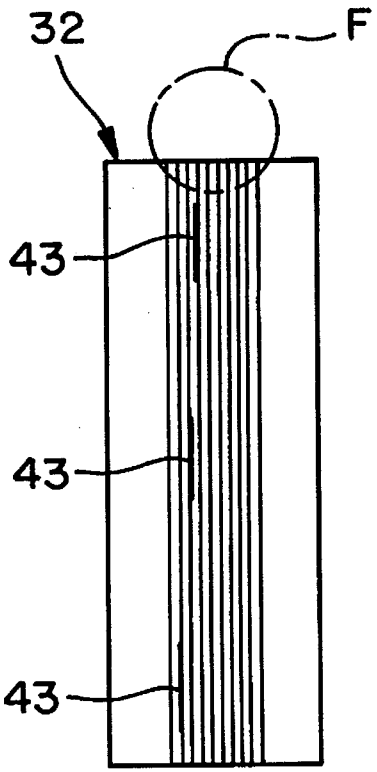
Figure 10:
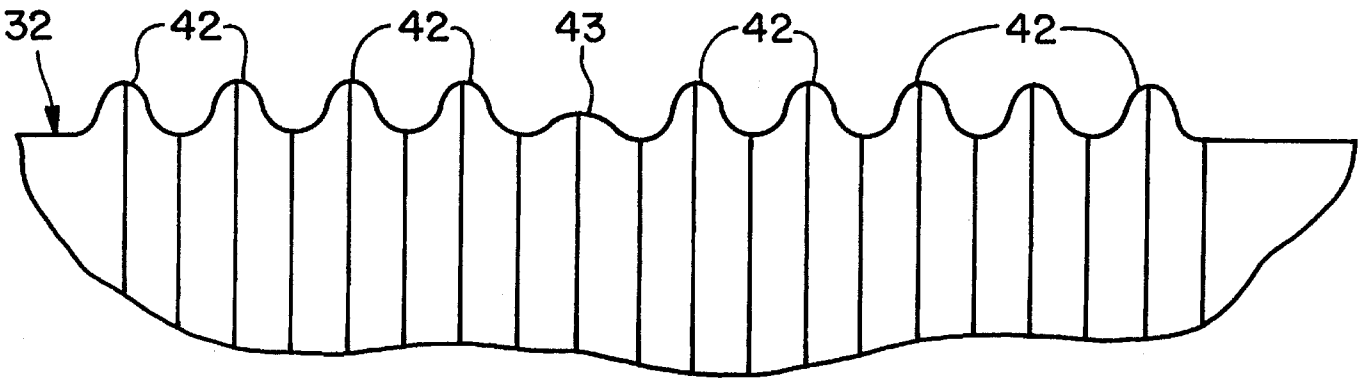
FIG. 10 is an enlarged front view showing a portion indicated by "F" in FIG. 9.

The upper roller 31 shown in FIGS. 7 and 8 is provided at its central portion of its peripheral surface with ten parallel and circumferential grooves. The roller 31 is also provided with low crest portions 41, which have centers circumferentially spaced by 45 degrees from each other and are disposed in convex portions between the adjacent grooves 40. The low crest portions 41, which are eight in number, are disposed in such positions that the adjacent two portions 41 are circumferentially spaced by 45 degrees and are located at the different but adjacent convex portions. Similarly, as shown in FIGS. 9 and 10, the lower roller 32 is provided with circumferential and parallel protrusions 42 corresponding to the grooves 40 and is also provided with eight low crest portions 43, which are circumferentially spaced by 45 degrees and are shifted in the axial direction. The upper and lower rollers 31 and 32 form the forming roller pair, as shown in FIG. 6. A driving force is transmitted to the upper and lower rollers 31 and 32 for driving them with the synchronized phase.

An example of the manufacturing method of the inner fin will be described below.

The band plate is roll formed by the forming apparatus 30 into the corrugated plate, which is then cut into predetermined lengths. The cut piece, i.e., inner fin is inserted into the tube, and is subjected to alkaline degreasing and to cleaning by immersing it in the flux solution. Then, the tube and the inner fin are fitted together, and the crest surfaces of the inner fin are brazed to the inner wall of the tube, whereby the tube accommodating the inner fin is completed.

According to the manufacturing method of the inner fin, a pair of the rollers simultaneously form the widthwise corrugated configuration and the concavities for forming the bypass passages. The manufacturing steps are remarkably simple.

Figure 11:
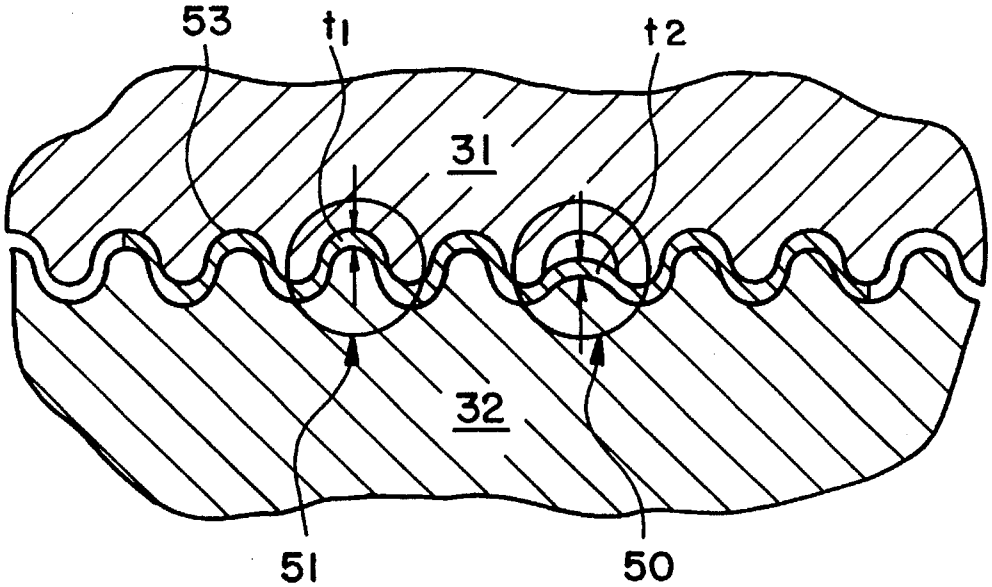
FIG. 11 is a schematic cross section for showing formation of an inner roller by upper and lower rollers.
Figure 12:
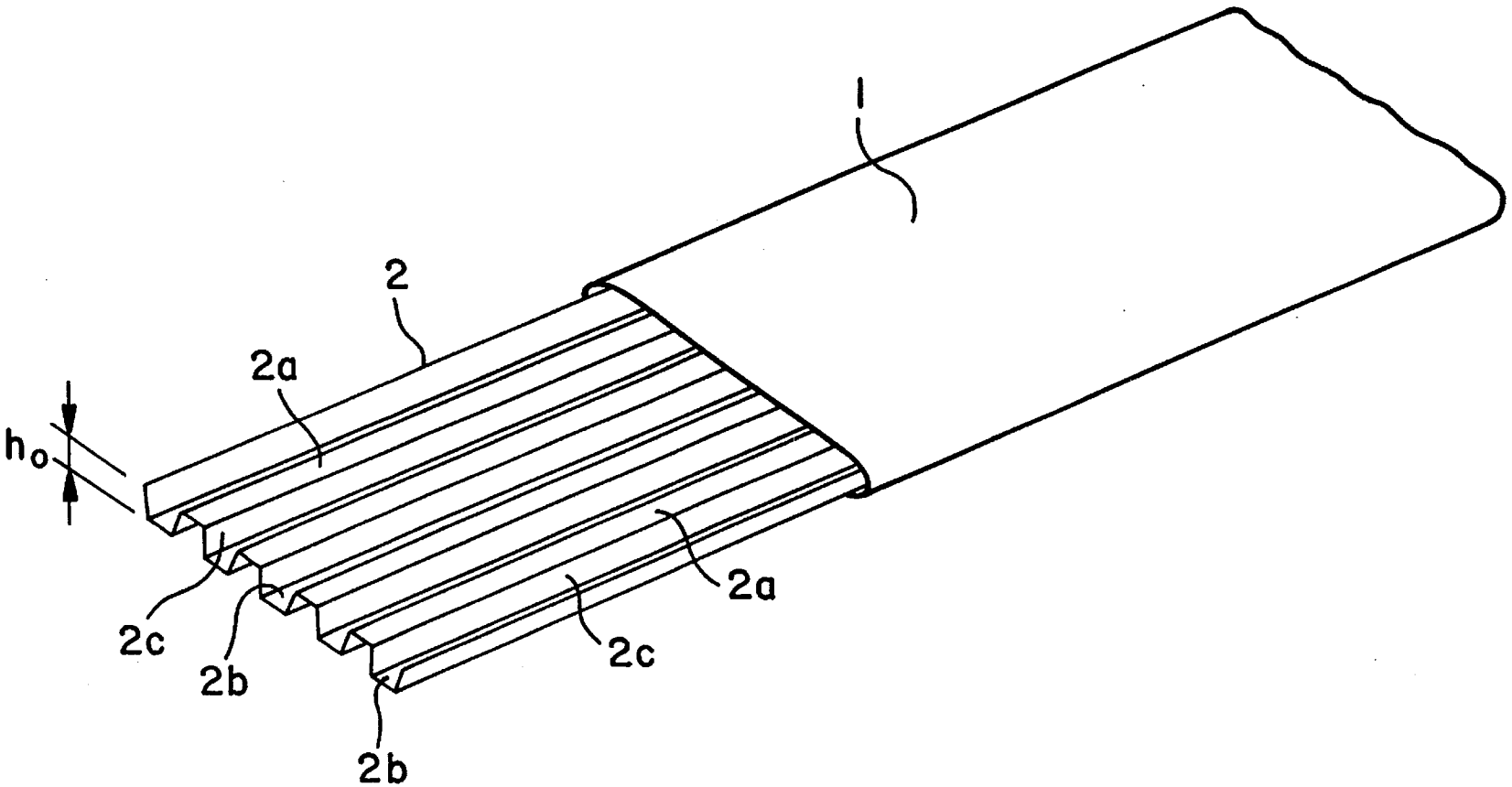
FIG. 12 (PRIOR ART)
FIG. 12 is a schematic perspective view showing an inner fin in the prior art, which is partially drawn out from a heat exchanger tube.

In the forming operation, for example, as shown in FIG. 11, half-worked (half-formed) portions 50, of which height is nearly half the height of the crest portion, remain in an inner fin 53 formed by the upper and lower rollers 31 and 32. Therefore, camber such as deformation or warpage, which may generate in the inner fin 53, is absorbed by the half-worked portions 50, and thus is not generated. In comparison between thicknesses t1 and t2 of a worked portion 51 and the half-worked portion 50, the thickness t2 of the half-worked portion 50 is larger than the other. According to the experiment, when the thickness t1 of the worked portion 51 is 0.2 mm, the thickness t2 of the half-worked portion 50 is 0.3 mm.

According to the structures in which the inner fin manufactured by the method described above is inserted into the heat exchanger tube, if one of the passages is clogged, the cooling medium in the clogged passage flows through the concavities to the adjacent passages, so that the total flow of the cooling medium in the passages is minimized, and thus the degree of reduction of the heat exchanger performance can be minimized. Generally, in the operation for inserting and joining the inner fin into the tube, such a disadvantage may be generated in that the flux due to the brazing, chips due to the cutting or the like clog the passage. Even if such disadvantage occurs, the reduction of the heat exchanger performance can be minimized, because the concavities can minimize the reduction of the flow of the cooling medium in the embodiment.

The embodiment has been described in connection with the inner fin and tube, of which configurations are schematically shown. However, the entire lengths of the tube and the inner fin fitted therein are not restricted. Also, the number of the concavities, wave-shaped grooves, the spaces between the concavities and others are not restricted to those of the illustrated embodiment.

According to the heat exchanger tube accommodating the inner fin of the invention, as described hereinabove, even when one or some of the passages defined by the inner fin are clogged for some reason, the fluid in the clogged passage(s) flows through the concavities to the adjacent passages, so that the reduction of the total flow of the fluid is suppressed, and thus the reduction of the heat exchanger performance is minimized.

Also, according to the manufacturing method of the inner fin of the invention, a pair of the rollers form the concavities, which form the bypass passages, simultaneously with the basic formation, so that the inner fin can be facilely manufactured in one manufacturing step.

Further, according to the manufacturing method of the invention, the concavities, which form relatively low portions in the inner fin, are formed discontinuously in the lengthwise direction. Therefore, the camber such as deflection and warpage can be prevented in the forming operation, and thus dimensional accuracy of the inner fin is improved, resulting in easy insertion and assembly of the inner fin into the heat exchanger tube.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A forming apparatus for processing band plate into an inner fin corrugated laterally to have a plurality of alternating crest portions and trough portions, a crest portion of said plurality of crest portions having a plurality of concavities defined by a reduced height portion thereof, said apparatus comprising:

an upper roller having a plurality of parallel grooves formed on a peripheral surface thereof so that a plurality of parallel protrusions are defined between adjacent ones of said grooves; and a lower roller having a plurality of parallel grooves formed on peripheral surface thereof so that a plurality of parallel protrusions are defined between adjacent ones of said grooves;

wherein protrusions of said upper roller engage with grooves of said lower; and a protrusion of one of said upper and lower rollers having a plurality of low crest portions having a height from a center of said respective roller less than a height of other portions of said protrusion so that said low crest portions form concavities in a crest portion of a corrugated inner fin formed between said upper and lower rollers.

2. A forming apparatus according to claim 1, wherein a clearance between said upper roller's protrusions and said lower roller's grooves is set at less than a thickness of said initial band plate.

3. A forming apparatus according to claim 2, wherein said rollers are disposed so that a clearance between said low crest portions and said grooves is at least as great as a thickness of said band plate.

4. A forming apparatus according to claim 3, wherein said low crest portions are shifted in an circumferential direction of said rollers such that said low crest portions are not aligned along a straight line in an axial direction of said rollers.

5. A method of processing a band plate into an inner fin corrugated laterally to have a plurality of alternating crest portions and trough portions, a crest portion of said plurality of crest portions having a plurality of concavities defined by a reduced height portion thereof, said method comprising the steps of:

engaging said band plate between a rotating upper roller and a rotating lower roller; and pressing said band plate with said upper roller and said lower roller, said upper roller having a plurality of parallel grooves formed on peripheral surface thereof so that a plurality of parallel protrusions are defined between adjacent ones of said grooves, said lower roller having a plurality of parallel grooves formed on peripheral surface thereof so that a plurality of parallel protrusions are defined between said adjacent grooves;

wherein protrusions of said upper roller engage with grooves of said lower rollers; and a protrusion of one of said upper and lower rollers having a plurality of low crest portions having a height from a center of said respective roller less than a height of other portions of said protrusion so that said low crest portions form concavities in a crest portion of a corrugated inner fin formed between said upper and lower rollers.

6. An apparatus for producing an inner fin having a plurality of parallel passages, said apparatus comprising:

a first roller having alternating parallel grooves and protrusions on a surface thereof; and a second roller having on a surface thereof alternating parallel grooves and protrusions which engage with corresponding ones protrusions and grooves of said first roller to press a sheet of material therebetween and thereby produce said inner fin;

wherein each of said inner fin parallel passages is defined by an engaged groove and protrusion of said rollers; and a protrusion of said first roller has a first low crest portion that is depressed in height relative to adjacent portions of said first roller protrusion to thereby produce a first concavity in said inner fin that extends between adjacent ones of said parallel passages.

7. The apparatus of claim 6, wherein said grooves and protrusions on each of said first and second rollers are disposed along a circumference of said first and second rollers, respectively.

8. The apparatus of claim 6, wherein said first roller has additional protrusions each having a low crest portion depressed in height relative to adjacent portions thereof to thereby produce additional concavities in said inner fin extending between adjacent ones of said parallel passages.

9. The apparatus of claim 8, wherein:

said low crest portions of said first roller additional protrusions are angularly displaced from said first low crest portion of said first roller along a circumference of said first roller; and said additional concavities in said inner fin are spaced from said first concavity along a longitudinal axis of said passages.

10. The apparatus of claim 9, wherein:

said low crest portions of said first roller additional protrusions are angularly displaced from one another along a circumference of said first roller; and said additional concavities in said inner fin are spaced from one another along a longitudinal axis of said passages.

11. The apparatus of claim 6, wherein a protrusion on said second roller has a first low crest portion depressed relative to adjacent portions of said second roller protrusion to thereby produce a second concavity in said inner fin extending between adjacent ones of said parallel passages.

12. The apparatus of claim 11, wherein said second roller has additional protrusions each having a low crest portion depressed relative to adjacent portions thereof to thereby produce additional concavities in said inner fin extending between adjacent ones of said parallel passages.

13. The apparatus of claim 12, wherein:

said low crest portions of said second roller additional protrusions are angularly displaced from said first low crest portion of said second roller along a circumference of said second roller; and said additional concavities in said inner fin are spaced from said second concavity along a longitudinal axis of said passages relative.

14. The apparatus of claim 13, wherein:

said low crest portions of said second roller additional protrusions are angularly displaced from one another along a circumference of said second roller; and said additional concavities in said inner fin are spaced from one another along a longitudinal axis of said passages relative.

15. The apparatus of claim 11, wherein said protrusion on said roller has additional low crest portions depressed relative to adjacent portions thereof to thereby produce additional concavities in said inner fin extending between adjacent ones of said parallel passages.

16. The apparatus of claim 6, wherein said protrusion of said first roller has additional protrusions each having a low crest portion depressed in height relative to adjacent portions thereof to thereby produce additional concavities in said inner fin extending between adjacent ones of said parallel passages.

concavity producing means defined on said second roller

17. An apparatus for producing an inner fin having a plurality of parallel passages, said apparatus comprising:

a first roller having alternating parallel grooves and protrusions on a surface thereof;

a second roller having on a surface thereof alternating parallel grooves and protrusions which engage with corresponding ones of said first roller grooves and protrusions to press a sheet of material therebetween and thereby produce said inner fin, each of said inner fin passages corresponding to an engaged groove and protrusion of said first and second rollers; and concavity producing means disposed on said second roller for producing a first concavity in said inner fin connecting adjacent ones of said parallel passages;

wherein said concavity producing means is a surface of one of said second roller protrusions defining a low crest portion depressed relative to adjacent portions of said second roller protrusion.

18. A method of producing an inner fin having a plurality of parallel passages, said method comprising the steps of:

engaging a sheet of material between a first roller having alternating parallel grooves and protrusions on a surface thereof, and a second roller having on a surface thereof alternating parallel grooves and protrusions which engage with corresponding ones of said first roller protrusions and grooves to form said parallel passages each corresponding to an engaged groove and protrusion of said first and second rollers;

pressing said sheet of material between a groove on said first roller and a portion of a protrusion on said second roller having a low crest portion depressed in height relative to adjacent portions of said second roller protrusion to thereby form a concavity ill said inner fin extending between adjacent ones of said parallel passages; and moving said sheet longitudinally past said first and second rollers.

19. The method of claim 18, wherein said engaging, pressing and moving steps are performed concurrently.

* * * * *